US005392499A

United States Patent [19]

Bertoldo

[11] Patent Number: 5,392,499

[45] Date of Patent: Feb. 28, 1995

[54] METHOD AND APPARATUS FOR SURFACE TREATMENT OF WET FABRIC WEBS IN A FINISHING MACHINE

[75] Inventor: Franco Bertoldo, Brogliano, Italy

[73] Assignee: Sperotto Rimar S.p.A., Thiene, Italy

[21] Appl. No.: 46,755

[22] Filed: Apr. 15, 1993

[51] Int. Cl.[6] ..... D06C 11/00

[52] U.S. Cl. ..... 26/28

[58] Field of Search ..... 26/28, 27, 19, 29; 51/74 R, 75, 266, 322, 323, 326; 28/163, 165, 167

[56] References Cited

U.S. PATENT DOCUMENTS

| | | | |
|---|---|---|---|
| 162,440 | 4/1875 | Webber, Jr. | 26/28 |
| 1,917,555 | 7/1933 | Shuttleworth | 26/28 |
| 3,700,404 | 10/1972 | Janisch et al. | 26/19 |
| 3,894,318 | 7/1975 | Ito et al. | 26/28 |
| 4,034,446 | 7/1977 | Rubaschek et al. | 26/2 R |
| 4,062,093 | 12/1977 | Klein | 26/27 |
| 4,112,627 | 9/1978 | de Kramer | 51/79 |
| 4,263,790 | 4/1981 | Stopp et al. | 26/14 |
| 4,607,409 | 8/1986 | Hishimuma et al. | 26/28 |
| 5,087,319 | 2/1992 | Held | 51/74 R |
| 5,109,630 | 5/1992 | Love et al. | 26/28 |
| 5,203,122 | 4/1993 | Campbell | 51/322 |
| 5,218,747 | 6/1993 | Riedel | 26/28 |

FOREIGN PATENT DOCUMENTS

| | | | |
|---|---|---|---|
| 574559 | 7/1924 | France | 26/28 |
| 2270361 | 12/1975 | France | D06C 23/02 |
| 2407051 | 8/1975 | Germany | D06C 23/02 |
| 40787 | 9/1986 | Japan | 26/28 |
| 2063322 | 6/1981 | United Kingdom | 26/28 |
| 2067614 | 7/1981 | United Kingdom | D06C 27/00 |
| 2088424 | 6/1982 | United Kingdom | D06C 11/00 |

*Primary Examiner*—Clifford D. Crowder
*Assistant Examiner*—Amy B. Vanatta
*Attorney, Agent, or Firm*—Cushman Darby & Cushman

[57] ABSTRACT

A method for surface treatment of wet fabric webs in a finishing machine containing an external housing, provided with an inlet zone and an outlet zone, through which a fabric web to be treated is run, and at least one grinder roller rotatably arranged inside it, against which the fabric web is caused to slide. The surface treatment of the fabric is carried out by using abrasive diamond material as the grinding material for the grinder roller.

14 Claims, 1 Drawing Sheet

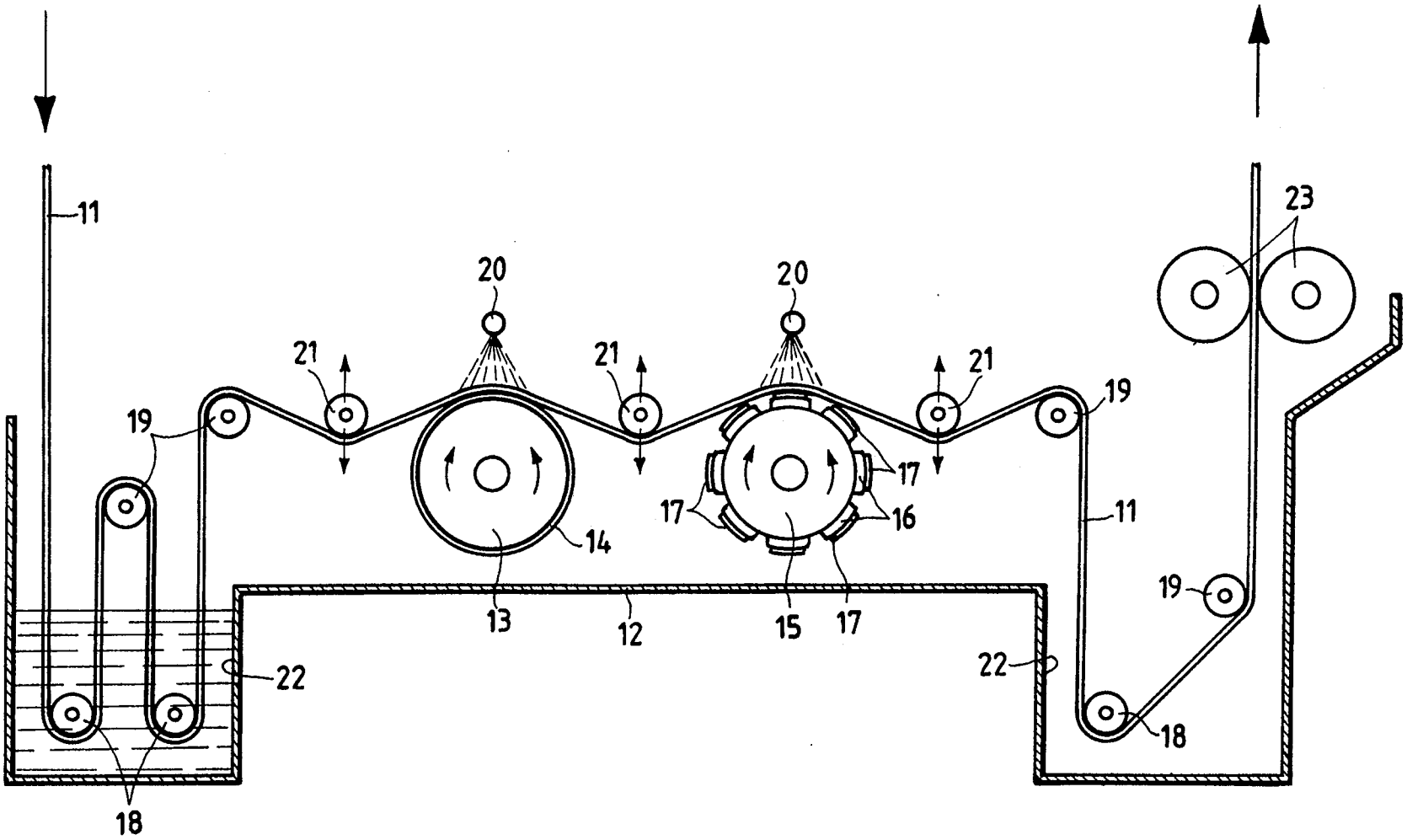
11
19
21
20
21
20
21
19
22
12
13
14
15
16
17
17
17
18
18
22
19
11
23

METHOD AND APPARATUS FOR SURFACE TREATMENT OF WET FABRIC WEBS IN A FINISHING MACHINE

BACKGROUND OF THE DISCLOSURE

The present invention relates to a method and an apparatus for surface treatment of wet fabric webs in a finishing machine.

At present, methods and apparatuses are known and used which, in order to carry out the surface treatment of dry fabrics, use one or more revolutionary rollers coated with a conventional abrasive tape.

Such a treatment method usually referred to as "fluffing", makes it possible for a treated fabric to be manufactured, from the surface of which some fibrous material has been partially removed. Consequently, the fabric displays a more or less marked surface fluff. In that way, a modification is accomplished in the treated fabric from both the visual and tactile viewpoints, which unfortunately causes, as a negative characteristic, a certain loss of strength of the fabric.

Furthermore, the use of the abrasive tape includes the drawback that it does not allow the surface treatment of wet fabrics to be carried out owing to the sudden degradation of the tape, which must be frequently replaced.

However, the need exists always for obtaining new "hand" and visual surface effects. For example, hand effects are required which are such as to soften the fabric while simultaneously preventing surface grind from being formed. Furthermore, visual effects are required which determine a fabric appearance which resembles a discoloration and/or ageing, as shown by an already used fabric.

SUMMARY OF THE INVENTION

The purpose of the present invention is hence of providing a solution for the above requirements through methods and apparatuses which overcome the drawbacks and disadvantages of the methods and apparatuses already known and used in the prior art.

This purpose according to the present invention is achieved by providing a method for surface treatment of wet fabric webs in a finishing machine containing an external housing, provided with an inlet zone and an outlet zone, through which a fabric web to be treated is run, and at least one grinder roller rotatably arranged inside it, against which the fabric web is caused to slide, characterized in that the surface treatment of the fabric is carried out by using abrasive diamond material as the grinding material for the grinder roller.

Furthermore, according to the present invention, a finishing machine for surface treatment of wet fabrics is proposed, which comprises an external housing, provided with an inlet zone and an outlet zone, through which a fabric web to be treated is caused to run, and at least one grinder roller rotatably arranged inside it, against which the fabric web is caused to run, characterized in that, in order to carry out the surface treatment, the grinder roller is provided with an external surface equipped with abrasive diamond material.

BRIEF DESCRIPTION OF THE DRAWING

The characteristics and advantages of the present invention will be clearer and more evident from the following exemplifying, non-limitative disclosure, made by also referring to the accompanying schematic drawing, in which:

FIG. 1 displays a preferred embodiment of the apparatus according to the invention.

DETAILED DESCRIPTION OF THE DRAWING

In the FIGURE, a preferred embodiment of apparatus is displayed which can be used in a finishing machine for the surface treatment of wet fabric webs according to the present invention.

The apparatus is essentially constituted by an external housing 12 comprising a tank 22 for water for impregnating a fabric web 11. The water is optionally admixed with suitable chemical products for favouring the treatment of the fabric. The continuous fabric web 11 is fed to the inlet of the housing 12 at an inlet zone and after being treated leaves the housing from an out let zone.

Inside the housing 12, according to the exemplifying embodiment displayed, a grinder roller 13 is provided, which can revolve both clockwise and counterclockwise, and on its radially outer peripheral surface is provided With abrasive diamond material 14. Furthermore, for example, in a downstream position from the first roller 13, a second grinder roller 15 is provided, which also can revolve both clockwise and counterclockwise, and bears on its radially outer peripheral surface a plurality of staves or stick elements 16 arranged according to generatrices of the roller 15. The staves or stick elements 16 bear, applied onto their external Surface, abrasive diamond material 17. In both cases, the abrasive diamond layer can be constituted either by a water resistant support coated with abrasive diamond material, or by directly applying the abrasive diamond material onto the grinder roller 13 or 15. In such a way, the roller can be used, without any problem, with wet fabric webs.

The fabric web 11 continuously fed to an inlet zone of the housing 12 is caused to run, by means of rollers 18, along a trajectory partially immersed in a Lowered tank 22 of the housing 12, which zone or contains an impregnation liquid or water, possibly with the aid of further rollers 19 which cause the fabric web to leave the tank after being so dipped and possibly before another, further immersion.

Furthermore mobile rollers 21 are provided, which, for example, can be moved upwards and downwards along vertical planes and are installed downstream and upstream of the grinder rollers 13 and 15. By being moved up and down, these mobile rollers 21 cause the contact between the fabric web and the grinder rollers 13 and 15 to take place along a larger or smaller contact angle so as to vary and adjust the winding angle of the fabric web into contact with the same treatment grinder rollers. Over the grinder rollers 13 and 15, spraying elements 20 are provided and perform the task of "fabric washing showers", suitable for favouring the grinding action.

At an outlet zone of the housing 12, further rollers are provided, similar to rollers 19, which divert the trajectory of the surface-treated fabric web 11 towards a further lowered zone or tank 22 of the housing 12, containing a possible washing liquid means and subsequently towards one pair of squeezing rollers 23, which act on the fabric web while the latter is leaving the housing after the treatment.

The grinder rollers can be provided in an optimal number in order to perform the required surface treatment action, and may be all of the same type and/or of both types, as indicated hereinabove. In fact, the rollers 13 with radially outer peripheral surface provided with abrasive diamond material 14, cause a surface shearing action to take place on the fibers of the fabric, with the fabric being consequently given a softer hand. On the contrary, the rollers 15 with the surface provided with localized portions 16 provided with the abrasive diamond material, such as the staves or stick elements, perform a mechanical action of flapping or shaking or on the surface of the fabric web 11, with consequent visual effect of wear and aging.

Advantageously, according to the present invention it may be useful it to variously combine the arrangement, the succession and the type of grinder rollers 13, 15, as well as-their revolution directions in order to obtain different effects of surface treatment. For example, an increase in the number of rollers may be useful in order to allow the fabric web 11 to run through the apparatus at a higher speed, with higher productivity and decreased costs.

Therefore, according to the present invention also a novel and original method is provided in order to perform the surface treatment of wet fabrics in a finishing machine comprising an external housing, such as the one which is illustrated and disclosed herein.

In fact, such a method consists in causing the fabric to be submitted to surface treatment, continuously fed at a fabric web, to interact with at least one grinder roller rotatably installed inside the housing using, as the grinding material for the grinder rollers, abrasive diamond material.

As previously mentioned, such a method as makes it possible all the desired purposes of both hand and visual surface effects to be achieved as presently desired. Such a method is in fact capable, first of all, of softening the fabric, while simultaneously preventing a surface fluff to be formed. Secondly, by means of the method according to the present invention, an appearance of the fabric can be obtained which is similar to a typical discoloration and/or ageing of an already used fabric.

The use of an abrasive diamond material supplies the possibility of submitting wet fabrics to surface treatment, to the contrary of by the prior art, i.e., by the abrasive tape.

Furthermore, the abrasive diamond material supplies the grinder rollers provided with it with a high wear resistance, with a long useful life and decrease of the operations of rollers or abrasive material replacement to a minimal number.

I claim:

1. A method for finishing a web of wet fabric, comprising:

(a) passing a web of fabric into an external housing through an inlet of an inlet zone, through an intermediate zone, and out of an outlet of an outlet zone, along a path, while guiding the web of fabric by rolling contact with a succession of guiding rollers located in each of said zones;

(b) wetting successive increments of said web upstream of said intermediate zone;

(c) in said intermediate zone, passing successive increments of said web, while wet, in grinding contact with the radially outer peripheral surface of at least one first type of grinder roller having a radially outer, peripheral surface provided throughout with a coating of diamond abrasive material;

(d) in said intermediate zone, passing successive increments of said web, while wet, in grinding contact with the radially outer peripheral surface of angularly successive ones of the staves of at least one second type of grinder roller having a radially outer peripheral surface provided with a plurality of angularly spaced staves, each aligned with a respective generatrix of the radially outer peripheral surface of the respective said second type of grinder roller and having a radially outer peripheral surface provided with a coating of diamond abrasive material;

steps (c) and (d) being conducted while said grinder rollers of said first and second types are arranged in alternation with one another within said intermediate zone of said external housing for rotation about respective longitudinal axes thereof, said axes being arranged transversally of said path, and while at least three of said guide rollers are functioning as respective mobile rollers, respectively disposed intermediate a respective two adjacent ones of said grinder rollers, upstream of the furthest upstream along said path of said two grinder rollers, and downstream of the furthest downstream along said path of said two grinder rollers and mounted for vertical adjustment; and (e) vertically adjusting said mobile rollers in such a sense as to cause said fabric web, when passing along said path under and in rolling contact with the furthest upstream of said three mobile rollers, over and in grinding contact with the furthest upstream of said two grinder rollers, under and in rolling contact with the intermediate one of said three mobile rollers, over and in grinding contact with the furthest downstream of said two grinding rollers, and under and in rolling contact with the furthest downstream of said three mobile rollers, to wrap about more and less about the radially outer peripheral surface of said first type grinder roller, and about more and less of the radially outer peripheral surface of said staves of said second type grinder roller, depending on vertical adjustment of position of said mobile rollers relative to said two grinder rollers.

2. The method of claim 1, further comprising:

conducting step (b) in an impregnation tank provided in said inlet zone of said external housing.

3. A finishing machine for surface treatment of a web of wet fabric, comprising:

an external housing having an inlet zone, an intermediate zone and an outlet zone, arranged such that successive movements of a web of fabric can enter the housing through an inlet of said inlet zone, pass along a path successively through said inlet zone, said intermediate zone and said outlet zone, and exit from the housing through an outlet of said outlet zone;

at least one first type of grinder roller having a radially outer, peripheral surface provided throughout with a coating of diamond abrasive material;

at least one second type of grinder roller having a radially outer peripheral surface provided with a plurality of angularly spaced staves, each aligned with a respective generatrix of the radially outer peripheral surface of the respective said second type of grinder roller and having a radially outer peripheral surface provided with a coating of diamond abrasive material;

said grinder rollers of said first and second types being arranged in alternation with one another within said intermediate zone of said external housing for rotation about respective longitudinal axes thereof, said axes being arranged transversally of said path;

a plurality of guide rollers arranged in said external housing for rotation about respective longitudinal axes thereof, which are arranged transversally of said path for rolling contact with the web of fabric for guiding said web of fabric along said path;

said guide rollers including at least three mobile rollers, respectively disposed intermediate a respective two adjacent ones of said grinder rollers, upstream of the furthest upstream along said path of said two grinder rollers, and downstream of the furthest downstream along said path of said two grinder rollers and mounted for vertical adjustment in such a sense as to cause said fabric web, when passing along said path under and in rolling contact with the furthest upstream of said three mobile rollers, over and in grinding contact with the furthest upstream of said two grinder rollers, under and in rolling contact with the intermediate one of said three mobile rollers, over and in grinding contact with the furthest downstream of said two grinding rollers, and under and in rolling contact with the furthest downstream of said three mobile rollers, to wrap about more and less about the radially outer peripheral surface of said first type grinder roller, and about more and less of the radially outer peripheral surface of said staves of said second type grinder roller, depending on vertical adjustment of position of said mobile rollers relative to said two grinder rollers.

4. The finishing machine of claim 3, wherein:

said inlet zone of said external housing includes an impregnation tank for coating successive increments of said web with liquid; and said guide rollers include guide rollers disposed in said inlet zone for guiding successive increments of said web into and out of said impregnation tank as said web passes along said path.

5. The finishing machine of claim 3, further including:

at least one sprayer disposed in said intermediate zone of said external housing and arranged to spray a fabric washing shower onto successive increments of said web as such increments are being ground by contact with a respective one of said grinder rollers.

6. The finishing machine of claim 3, further including:

at least one pair of squeezing rollers disposed in said outlet zone of said external housing on opposite sides of said path and arranged for rolling squeezing contact with successive increments of said web for squeezing liquid therefrom.

7. The finishing machine of claim 3, wherein:

said grinder rollers are reversibly rotatable about said axes thereof.

8. A finishing machine for surface treatment of a web of web fabric, comprising:

an external housing having an inlet zone, an intermediate zone and an outlet zone, arranged such that successive movements of a web of fabric can enter the housing through an inlet of said inlet zone, pass along a path successively through said inlet zone, said intermediate zone and said outlet zone, and exit from the housing through an outlet of said outlet zone;

at least two grinder rollers having a radially outer, peripheral surface provided throughout with a coating of diamond abrasive material;

said at least two grinder rollers being arranged within said intermediate zone of said external housing for rotation about respective longitudinal axes thereof, and axes being arranged transversally of said path;

a plurality of guide rollers arranged in said external housing for rotation about respective longitudinal axes thereof, which are arranged transversally of said path for rolling contact with the web of fabric for guiding said web of fabric along said path;

said guide rollers including at least three mobile rollers, respectively disposed upstream, intermediate and downstream along said path of said at least two grinder rollers and mounted for vertical adjustment in such a sense as to cause said fabric web, when passing along said path under and in rolling contact with said three mobile rollers, and to wrap about more and less about the radially outer peripheral surface of said at least two grinder rollers, depending on vertical adjustment of position of said mobile rollers relative to said at least two grinder rollers.

9. The finishing machine of claim 8, wherein:

said at least two grinder rollers have a radially outer peripheral surface provided with a plurality of angularly spaced staves, each aligned with a respective generatrix of the radially outer peripheral surface and provided with a coating of diamond abrasive material.

10. The finishing machine of claim 8, wherein:

one of said two grinder rollers has its outer peripheral surface provided with a coating of diamond abrasive material and the other has its outer peripheral surface provided with staves having a coating of diamond abrasive material.

11. The finishing machine of claim 8, wherein:

said inlet zone of said external housing includes an impregnation tank for coating successive increments of said web with liquid; and said guide rollers include guide rollers disposed in said inlet zone for guiding successive increments of said web into and out of said impregnation tank as said web passes along said path.

12. The finishing machine of claim 8, further including:

at least one sprayer disposed in said intermediate zone of said external housing and arranged to spray a fabric washing shower onto successive increments of said web as such increments are being ground by contact with a respective one of said grinder rollers.

13. The finishing machine of claim 8, further including:

at least one pair of squeezing rollers disposed in said outlet zone of said external housing on opposite sides of said path and arranged for rolling squeezing contact with successive increments of said web for squeezing liquid therefrom.

14. The finishing machine of claim 8, wherein:

said grinder rollers are reversibly rotatable about said axes thereof.

* * * * *